United States Patent [19]

Kivi et al.

[11] 4,053,855

[45] Oct. 11, 1977

[54] METHOD AND ARRANGEMENT TO ELIMINATE MULTIPACTING IN RF DEVICES

[75] Inventors: Aare Kivi, Massapequa, N.Y.; Louis Feit, Fairlawn, N.J.

[73] Assignee: International Telephone and Telegraph Corporation, Nutley, N.J.

[21] Appl. No.: 626,161

[22] Filed: Oct. 28, 1975

[51] Int. Cl.[2] ..... H01P 1/20; H01P 7/06; H01P 3/12

[52] U.S. Cl. ..... 333/73 W; 333/83 R; 333/98 R

[58] Field of Search ..... 333/98 R, 98 P, 98 M, 333/99 P, 73 R, 73 W, 83 R; 313/106, 107; 174/127, 144, 140 CR

[56] References Cited

U.S. PATENT DOCUMENTS

| | | | |
|---|---|---|---|
| 3,441,784 | 4/1969 | Heil | 333/98 R X |
| 3,895,250 | 7/1975 | Christgau et al. | 313/106 |
| 3,900,755 | 8/1975 | Tisdale et al. | 333/98 R X |
| 3,909,755 | 9/1975 | Kaunzinger | 333/73 W |

OTHER PUBLICATIONS

Harvie — "Multipactor Effect" in Encyclopedic Dictionary of Physics, vol. 4, Dergamon Press 1961; pp. 745–746.

*Primary Examiner*—Alfred E. Smith
*Assistant Examiner*—Marvin Nussbaum
*Attorney, Agent, or Firm*—John T. O'Halloran; Alfred C. Hill

[57] ABSTRACT

An RF device disposed in a vacuum-like environment including two RF electrodes capable of supporting multipacting in at least a RF high voltage region thereof has disposed therebetween a solid dielectric material having a given dielectric constant and a given dielectric strength to eliminate multipacting.

4 Claims, 1 Drawing Figure

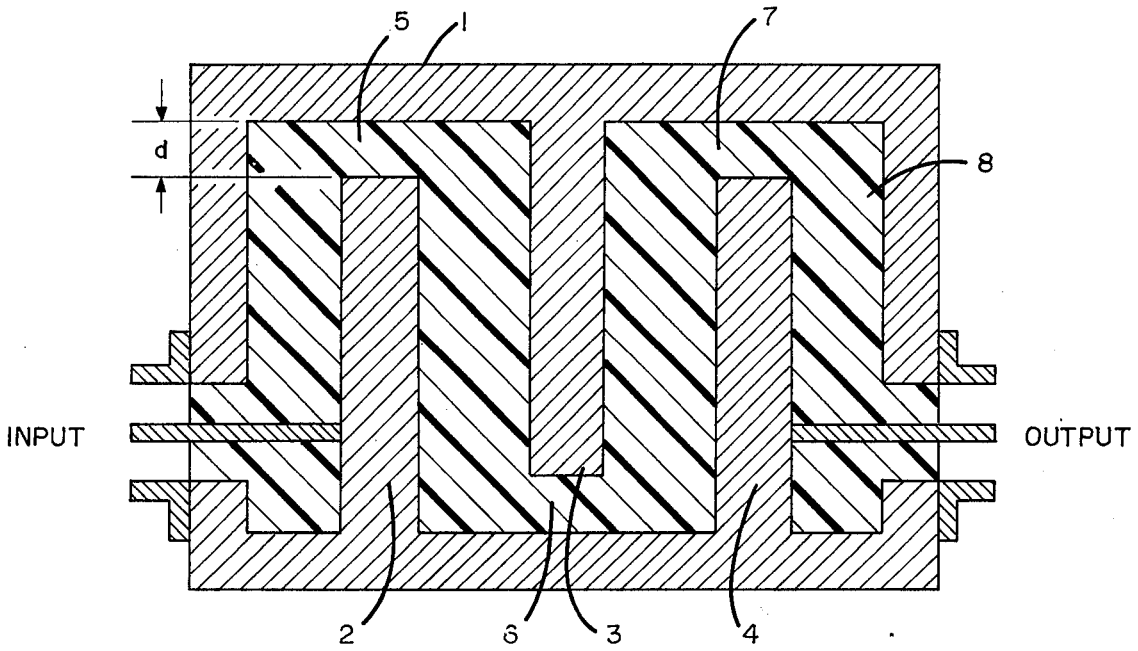
5
1
7
d
8
INPUT
OUTPUT
2
6
3
4

METHOD AND ARRANGEMENT TO ELIMINATE MULTIPACTING IN RF DEVICES

BACKGROUND OF THE INVENTION

This invention relates to radio frequency (RF) devices and more particularly to such devices operating in a vacuum-like environment.

During recent years the electronics industry has shown considerable interest in eliminating RF voltage breakdown occurrence in RF and microwave components designed for operation in space or a similar vacuum-like environment.

For spacecraft components such as filters, diplexers, switches and antennas, voltage breakdown results in a loss of transmission. It reduces efficiency of the component by an increase of insertion loss, impedance mismatch or by de-tuning, and more severely a permanent damage to the component may result by local heating effects.

The RF voltage breakdown in the presence of moderate to high RF power levels and in pressures lower than $10^{-2}$ millimeters of mercury is caused by the secondary electron emission from RF electrodes of the RF device. The RF electrodes are defined as the center conductor of a TEM resonator and cavity wall (or tuning disc) or terminals of an RF switch or antenna. Under condition that the electron emission coefficient of electrodes is greater than unity (this includes most conductors and insulators) the high energy primary electrons upon impact on a solid surface release a greater number of secondary electrons. If the mean free path of electrons is longer than the electrode separation d the secondary electrons are accelerated by multiple half-cycles of RF field and obtain the energy levels of the primary electrons. This process repeats itself until the multiple impacting or multipacting of electrons constitutes a space charge saturation. The space charge saturation lowers RF high voltage gap inpedance and gives rise to RF voltage breakdown.

In the past to avoid multipacting the component manufacturers have pressurized the cavities of microwave components with suitable inert gas. Component pressurization requires a pressure vessel, or the components are designed with heavier housing to withstand expected pressure levels usually greater than 760 millimeters of mercury in high vacuum. The pressurization arrangement adds volume and weight and reduces the reliability of the design.

SUMMARY OF THE INVENTION

An object of the present invention is to provide a method and an arrangement to eliminate multipacting in RF devices disposed in a vacuum-like environment which overcomes the disadvantages of the prior art arrangements mentioned hereinabove.

A feature of the present invention is the provision of an arrangement to eliminate multipacting in radio frequency (RF) devices disposed in a vacuum-like environment comprising: a RF device disposed in the environment, the device having two RF electrodes capable of supporting multipacting in a RF high voltage region thereof; and a dielectric material having a given dielectric constant and a given dielectric material having a given dielectric constant and a given dielectric strength disposed between the two electrodes in at least the region to eliminate multipacting.

Another feature of the present invention is the provision of a method of eliminating multipacting in radio frequency (RF) devices having two RF electrodes capable of supporting multipacting in a RF high voltage region thereof when the RF device is in a vacuum-like environment comprising the step of: placing a dielectric material having a given dielectric constant and a given dielectric strength between the two electrodes in at least the region.

BRIEF DESCRIPTION OF THE DRAWING

The above-mentioned and other features and objects of this invention and the manner of obtaining them will become more apparent by reference to the following description taken in conjunction with the drawing, the single FIGURE of which is a cross-sectional view of a typical RF filter incorporating the arrangement in accordance with the principles of the present object to eliminate multipacting.

DESCRIPTION OF THE PREFERRED EMBODIMENT

In accordance with the principles of the present invention a RF device disposed in a vacuum-like environment, such as space, having two RF electrodes capable of supporting multipacting in a RF high voltage region thereof has a dielectric material with a given dielectric constant and a given dielectric strength disposed between the two RF electrodes in at least the high voltage region thereof to eliminate multipacting. One example of the arrangement to eliminate multipacting in RF devices disposed in a vacuum-like environment is illustrated in the Figure of the drawing which illustrates a typical RF filter including a cavity having a cavity wall 1 and a plurality of interdigital resonators 2, 3 and 4. The cavity wall 1 is one RF electrode and the center conductors comprising resonators 2, 3 and 4 is the second RF electrode between which multipacting can occur, particularly in the RF high voltage regions 5, 6 and 7. In accordance with the principles of this invention to eliminate multipacting, a solid dielectric material 8 having a given dielectric constant and a given dielectric constant and a given dielectric strength completely fills the cavity. Examples of dielectric materials that may be employed in the practice of this invention are alumina, members of the ceramic family, fused silica, Rexolite 1422 and Rexolite 2200.

The dielectric material must possess satisfactory electrical properties, such as a low loss tangent which is equal to or less than 0.001 and moderate to high dielectric strength. The loading of the cavity by solid dielectric material 8 does not support the secondary electron resonance or multipacting for the following reasons.

1. The effective conductor separation d at the high voltage regions 5, 6 and 7 between the two electrodes is increased by the loading, that is, the electrical separation is increased by a factor of the dielectric constant of dielectric material 8.
2. Voltage breakdown between the electrodes depends on the dielectric strength of the dielectric material 8.
3. The initial time-phase relationship between the primary and secondary electrons released for synchronous acceleration of the secondary relation is not focused or supported because of the dielectric constant of dielectric material 8 and the resultant phase delay.

4. The separation and frequency product fd is small and does not support multipacting in vacuums.

While we have described above the principles of our invention in connection with specific apparatus it is to be clearly understood that this description is made only by way of example and not as a limitation to the scope of our invention as set forth in the objects thereof and in the accompanying claims.

We claim:

1. An arrangement to eliminate multipacting in radio frequency (RF) devices disposed in a vacuum-like environment comprising:

a RF device disposed in said environment, said device having two RF electrodes capable of supporting multipacting in a RF high voltage region therebetween; and a dielectric material having a given dielectric constant and a given dielectric strength disposed between said two electrodes in at least said region to eliminate multipacting, said dielectric material completely filling said region;

said environment is space; and said RF device including a microwave filter having a cavity with a cavity wall providing one of said two electrodes and a plurality of resonators providing the other of said two electrodes; and said dielectric material fills said cavity.

2. An arrangement according to claim 1, wherein said plurality of resonators are interdigital resonators.

3. An arrangement to eliminate multipacting in radio frequency (RF) devices disposed in a vacuum-like environment comprising:

a RF device disposed in said environment, said device having two RF electrodes capable of supporting multipacting in a RF high voltage region therebetween; and a dielectric material having a given dielectric constant and a given dielectric strength disposed between said two electrodes in at least said region to eliminate multipacting, said dielectric material completely filling said region;

said RF device including a microwave filter having a cavity with a cavity wall providing one of said two electrodes and a plurality of resonators providing the other of said two electrodes; and said dielectric material fills said cavity.

4. An arrangement according to claim 3, wherein said plurality of resonators are interdigital resonators.

* * * * *